United States Patent [19]

Suzuki et al.

[11] Patent Number: 4,612,061

[45] Date of Patent: Sep. 16, 1986

[54] METHOD OF MANUFACTURING PICTURE TUBE SHADOW MASK

[75] Inventors: Fumio Suzuki, Saitama; Makoto Fujinuma; Yasuhisa Ohtake, both of Fukaya; Michihiko Inaba, Yokohama, all of Japan

[73] Assignee: Kabushiki Kaisha Toshiba, Kawasaki, Japan

[21] Appl. No.: 710,979

[22] Filed: Mar. 12, 1985

[30] Foreign Application Priority Data

Mar. 15, 1984 [JP] Japan ..... 59-48145
Mar. 15, 1984 [JP] Japan ..... 59-48147

[51] Int. Cl.[4] ..... C23C 8/10

[52] U.S. Cl. ..... 148/6.35; 148/14; 445/47; 313/402

[58] Field of Search ..... 148/14, 6.35; 445/47; 313/402

[56] References Cited

U.S. PATENT DOCUMENTS

| | | | |
|---|---|---|---|
| 3,708,351 | 1/1973 | Dallas | 148/6.35 |
| 3,925,109 | 12/1975 | Nilsen | 148/6.35 |
| 3,935,036 | 1/1976 | Kinsch | 148/6.35 |
| 3,967,985 | 7/1976 | Izumi | 148/6.35 |

*Primary Examiner*—Sam Silverberg
*Attorney, Agent, or Firm*—Cushman, Darby & Cushman

[57] ABSTRACT

A method of manufacturing a picture tube shadow mask wherein a thin metal plate containing iron and nickel as major components is first etched to form a plurality of mask apertures, then, annealing of the metal plate is performed and, after being cooled in a reducing atmosphere, a darkened oxide layer is formed on the surface of the annealed metal plate by subjecting the metal plate at first to a relatively weak oxidizing steam atmosphere and then to a relatively strong oxidizing steam atmosphere.

5 Claims, 5 Drawing Figures

METHOD OF MANUFACTURING PICTURE TUBE SHADOW MASK

BACKGROUND OF THE INVENTION (a) Field of the Invention

The present invention relates to a method of manufacturing a picture tube shadow mask and, more particularly, to a method of manufacturing a shadow mask of an Fe—Ni alloy.

(b) Description of the Prior Art

A high-purity, low-carbon steel plate of rimmed steel or aluminum killed steel has been used for a color picture tube shadow mask. The use of this material was determined in consideraion of material supply capacity, manufacturing cost, machining properties, and mechanical strength. However, such a conventional material has a large thermal expansion coefficient (about $12\times10^{-6}/°$ C. for 0° to 100° C.). The electron beam transmittance of a conventional shadow mask is about 15 to 20%, and many electron beams impinge thereupon, so that the shadow mask itself is heated to a temperature of 30° to 80° C. As a result, the shadow mask is thermally deformed, changing the radius of curvature thereof with respect to a phosphor screen, thereby degrading color purity. Such degradation is called a purity drift (PD). In a conventional color picture tube having a large mask aperture pitch, a wide margin (to be referred to as a guard band quantity hereinafter) for a positional error between the phosphor screen and the electron beam is guaranteed. Even if the shadow mask is thermally deformed to some extent, degradation of color impurity tends not to occur. However, in a high resolution color picture tube used in a character and graphic display unit or a general commercial picture tube having a flat faceplate and a small pitch compatible with character broadcast, the above-mentioned margin is not always sufficient. More specifically, in a high resolution color picture tube, since the aperture pitch is very small, the aperture size itself is also small (140 μm at a pitch of 0.3 mm, or 85 μm at a pitch of 0.2 mm). The guard band quantity is inevitably small. In addition, in order to obtain such a small aperture size by photoetching, the mask plate must have a small thickness, thereby decreasing the heat capacity. As compared with a thick plate, the thermal expansion quantity of such a thin mask plate is increased under identical conditions, thereby degrading the color purity.

In the flat faceplate color picture tube, the radius of the curvature of the mask is larger than that of a normal color picture tube. Even if the mask of the flat tube is subjected to the same thermal expansion influence as in the normal tube, the electron beams passing through the mask apertures are greatly deviated from the target positions on the phosphor screen. In addition to this disadvantage, since the pitch is small, the guard band quantity is small, and the color purity tends to be degraded. In order to resolve the above problems, various methods have been proposed. For example, in Japanese Patent Publication No. 42-25446 and Japanese Patent Disclosure Nos. 50-58977 and 50-68650, an iron-nickel alloy having a small thermal expansion coefficient, e.g., a 36% Ni—Fe Invar alloy (having a thermal expansion coefficient of about 0 to $2.0\times10^{-6}/°$ C. for 0° to 100° C.) or a 42% Ni—Fe alloy (having a thermal expansion coefficient of about $5.0\times10^{-6}°$ C. for 0° to 100° C.) is used as a material for a shadow mask. However, such a material cannot satisfy practical application conditions.

This is partially because the Invar material of Fe—Ni alloy has poor etching and molding properties as compared with those of the conventional low-carbon steel plate. With respect to the etching method, various proposals have been made as exemplified in Japanese Patent Publication No. 59-32859 and Japanese Patent Disclosure No. 59-149638. The shadow mask must have a surface curved with high precision. Tolerance for the radius R of curvature of 1,000 mm is as strict as ±5 mm. However, as compared with the iron-based alloy, the Fe—Ni alloy has a high mechanical strength and a poor spherical formability by pressing or the like even after annealing under the same conditiohs. For example, as shown in FIG. 1, when an Fe—Ni mask having a thickness of 0.2 mm is formed spherically and a local recess is formed with respect to a standard radius R of curvature, a depth d of the recess which is not more than 20 μm substantially satisfies the tolerance requirement for color purity. FIG. 2 is a graph showing the recess depth as a function of the yield strength in a 14 inch type shadow mask. As apparent from FIG. 2, the yield strength must be less than $20kg/mm^2$ so as to limit the depth to 20 μm or less. When a shadow mask of an Fe—Ni alloy material is annealed in an annealing furnace in a hydrogen atmosphere provided for the conventional shadow mask of aluminum killed steel material, the yield strength (a curve b) of the Fe—Ni alloy is higher than the yield strength (a curve a) of the aluminum killed low-carbon steel, as shown in FIG. 3. The yield strength of the Fe—Ni alloy is decreased only to 29 to 30 $kg/m^{-2}$ even if it is annealed at a high temperature of 900° C. Referring to FIG. 2, the yield strength of the Fe—Ni alloy does not show a yield phenomenon inherent to carbon steel and is represented by the tensile strength when the Fe—Ni alloy is elongated by 0.2%. In this manner, the effective peripheral portion of the shadow mask of the Fe—Ni alloy material is particularly subject to deformation and recessing, thereby presenting the problem of degradation in color purity due to deformation. While in order to improve anticorrosion and heat radiation properties of the shadow mask to be incorporated in a tube, a desired curved surface is obtained by pressing and a darkened oxide layer (to be referred to as a darkened layer hereinafter) is formed on the surface of the shadow mask. Although it has been assumed that the darkened layer need not be formed on the Fe—Ni shadow mask due to the presence of Ni having good anticorrosion properties, a typical difference between the electron beam mobility (i.e., PD quantity) of the Fe—Ni alloy without the darkened layer caused by thermal deformation thereof and that of the aluminum killed low carbon steel cannot be observed even if the Fe—Ni has a small thermal expansion coefficient. This is because heat radiation is degraded since the darkened layer is not formed on the shadow mask, and a thermal conductivity of the Fe—Ni alloy is lower than that of the aluminum killed low-carbon steel. Thus, under identical operating conditions, the Fe—Ni shadow mask has a higher temperature than that of the low-carbon steel shadow mask. Therefore, unless the darkened layer having good heat radiation is formed on the shadow mask, the low thermal expansion of the Fe—Ni material cannot be effectively utilized, resulting in degradation of color purity caused by thermal deformation. However, it is very difficult to form a dense, darkened layer on the Fe—Ni alloy with good adhesion by means of a conventional method since Fe—Ni alloy has good anticorrosion properties. The darkened layer tends to be nonuniform due to impurities contained in the Fe—Ni alloy or surface contamination of the Fe—Ni mask. Consequently, a red rust is partially formed on the surface of the Fe—Ni mask. Furthermore, during formation of the darkened layer, a stress acts on the coarse inner wall surface of each shadow mask aperture due to the difference between the thermal expansion coefficients of the darkened layer and the shadow mask material. In a worst case, the darkened layer peels from the surface of the Fe—Ni alloy. Rust increases in the area of red rust formation during subsequent heat treatment to vary the aperture sizes. As compared with the darkened layer, the red rust layer more easily peels from the Fe—Ni material. The peeled, darkened and red rust layers cause a decrease in breakdown voltage, resulting in a notable disadvantage to the color picture tube.

SUMMARY OF THE INVENTION

It is an object of the present invention to provide a method of manufacturing a shadow mask so as to easily perform the pressing of a shadow mask of an Fe—Ni alloy and to form a darkened layer having a uniform density and good anticorrosion and heat radiation properties, and to provide a color picture tube having good white uniformity (WU) quality and a small purity drift.

In order to achieve the above object of the present invention, there is provided a method of manufacturing a picture tube shadow mask, having at least the steps of forming a plurality of mask apertures in a thin metal plate having iron and nickel as major constituents, annealing the metal plate with the plurality of mask apertures, and forming a darkened oxide layer on the annealed metal plate, wherein a cooling after annealing is performed in a reducing atmosphere, and the darkened oxide layer is formed in a weakly oxidizing steam atmosphere during a first half period and in a strongly oxidizing steam atmosphere during a second half period.

According to the present invention, annealing of the shadow mask of an Fe—Ni alloy is performed before the shadow mask is pressed. After the shadow mask is annealed, it is cooled in a reducing atmosphere in a furnace, thereby decreasing the yield strength of the shadow mask. Under this condition, the Fe—Ni material is pressed to control the radius of curvature. At the same time, the surface of the shadow mask is prevented from being converted to stainless steel so as to obtain a surface which easily allows a growth of an oxide film. Thus, a darkened oxide film is formed in a weakly oxidizing atmosphere in a heating furnace during the first half period and in a strongly oxidizing atmosphere during the second half period. The darkened oxide film formed in this manner has a high density, good adhesion strength, sufficient darkness and a uniform thickness.

According to the present invention, annealing, if performed in a vacuum, is performed at a temperature of 1,000° C. or higher, preferably within the range of 1000° to 1200° C. at a pressure of $10^{-1}$ torr or higher, preferably within the range of $10^{-1}$ to $10^{-5}$ torr. The shadow mask is then cooled in a reducing atmosphere, e.g., hydrogen gas to a temperature of about 500° C.

The darkened layer is formed in a steam atmosphere obtained by supplying steam to a furnace at a rate of 20 to 50 $m^3$/hr per unit volume of the furnace at a temperature of 500° to 700° for 10 minutes or more as the first half period. During the second half period, i.e., for another 10 minutes or more, steam is supplied at a rate of 0 to 20 $m^3$/hr per unit volume of the furnace at a temperature of 550° to 750° C. The oxidation effect can be gradually increased without providing the first and second half periods for weak and strong oxidizing effects.

The shadow mask is preferably kept in a deoxidiazing atmosphere after the annealing step until the step of forming a darkened layer is initiated.

DESCRIPTION OF THE PREFERRED EMBODIMENT

An embodiment will be described hereinafter wherein an Invar alloy is used as a shadow mask material having an Fe—Ni alloy as a major constituent.

TABLE 1

Composition of shadow mask material (% by weight)

| Type | Composition | | | | | | | |
|---|---|---|---|---|---|---|---|---|
| | C | Mn | Si | P | S | Al | Ni(+Co) | Fe |
| Invar alloy | 0.009 | 0.47 | 0.13 | 0.005 | 0.002 | — | 36.5 | Bal |
| Al killed low-carbon steel | 0.002 | 0.30 | <0.01 | 0.016 | 0.009 | 0.052 | — | Bal |

Figure 1:
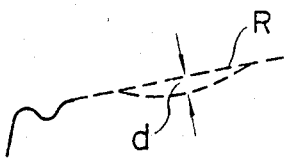
FIG. 1 is a representation for explaining deformation of a shadow mask.
Figure 2:
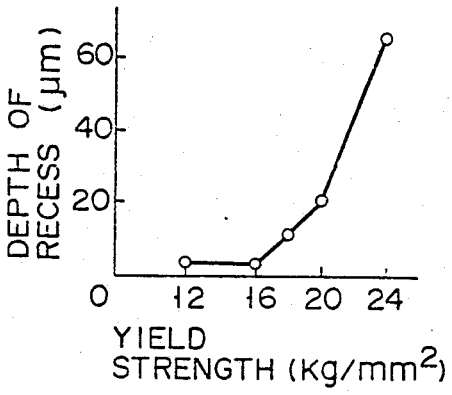
FIG. 2 is a graph showing the depth of the recess as a function of the yield strength of the shadow mask.
Figure 3:
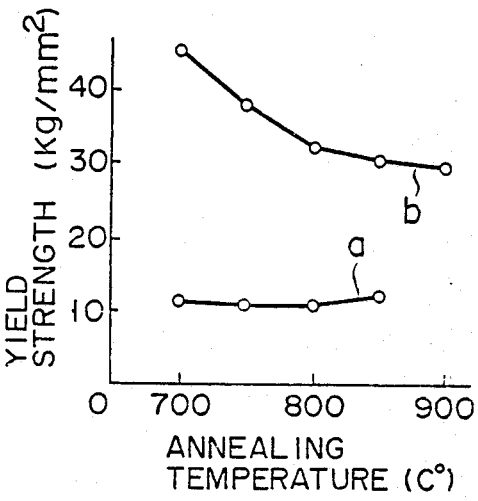
FIG. 3 and 4 are graphs each showing the yield strength as a function of the annealing temperature.
Figure 4:
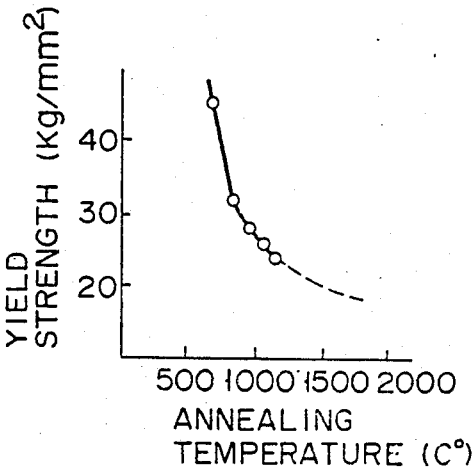

FIG. 4 shows the yield strength of a shadow mask having a 36 Ni Invar alloy when the annealing temperature is increased while the shadow mask is placed in a hydrogen atmosphere (having a dew point of 10° C.) in an annealing furnace. As is apparent from FIG. 4, even if the 36 Ni Invar alloy is annealed at a high temperature of 1,200° C., the yield strength thereof is decreased only to 24 kg/$mm^2$. In order to decrease the yield strength to a problem-free 20 kg/$mm^2$ or less, the annealing temperature must fall within the range of 1,500° to 1,700° C. from extrapolation with reference to FIG. 4. However, since the melting point of the Invar alloy is 1,440° to 1,450° C., such annealing cannot be performed.

Figure 5:
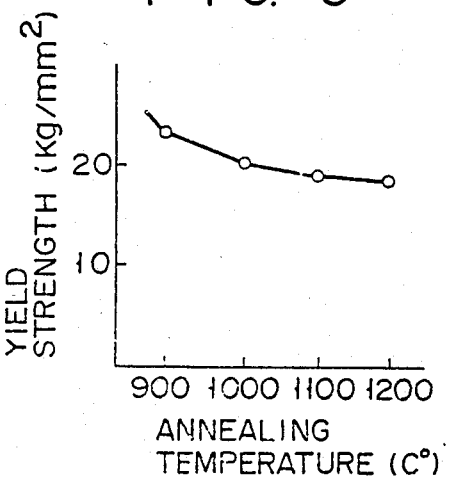
FIG. 5 is a graph showing the yield strength as a function of the vacuum annealing temperature.

As described in Japanese Patent Disclosure No. 59-27433, the presnt inventors examined the crystal structure of the annealed metal plate, and found that the inner crystal grains grew significantly upon an increase in the annealing temperature when hydrogen annealing was performed, but the crystal growth on the surface was very slight. The present inventors assumed that the insufficient surface crystal growth was associated with the yield strength and that the yield strength had to reach 20 kg/$mm^2$ before the surface crystal grains would grow in the same manner as the inner crystal grains. On this account, according to the present inventors, a further assumption was made that Mn, P, S and the like having high vapor pressures among the impurities concentrated in the surface crystal interface could be evaporated to accelerate the surface crystal grain growth. Annealing was performed in a vacuum of $10^{-2}$ torr at a temperature of 900° to 1,200° C. for 10 minutes. As shown in FIG. 5, a yield strength of 20 kg/$mm^2$ or less could be obtained at a high annealing temperature of 1,000° C. or higher. In this case, the surface crystal growth did not differ from the inner crystal growth. As is apparent from Table 2 showing the analysis results of impurities in the surface layer having a thickness of 1/20 or less of the entire thickness, impurities such as Mn, P and S are greatly decreased.

TABLE 2

| Annealing in vacuum | Composition before and after annealing (% by weight) | | | | | | |
|---|---|---|---|---|---|---|---|
| | C | Mn | Si | P | S | Ni(+Co) | Fe |
| Before annealing | 0.009 | 0.47 | 0.13 | 0.005 | 0.002 | 36.5 | Bal |
| After annealing | 0.007 | 0.052 | 0.12 | <0.001 | <0.001 | 36.3 | Bal |

The vacuum-annealed mask was pressed to obtain a smooth surface of high precision. The surface of the mask was then darkened in $CO_2+O_2$ gas, air and steam atmospheres at a temperature of 560° C. for 15 minutes. Only a thin blackish-purple oxide film was formed on the mask surface. The resultant mask was incorporated in a color picture tube, and the purity drift was measured. Even when the Invar material had a small thermal expansion coefficient, the purity drift was only slightly improved as compared with that of the aluminum-killed steel mask. This was because the darkened aluminum-killed steel mask had heat radiation of 0.6 and the darkened Invar mask 0.3 or less as compared to the completely darkened layer which is assumed to have a heat radiation of 1. To find out another cause, the mask temperature in operation was measured by attaching a thermocouple to the mask surface. As a result, it was found that the temperature of the Invar mask was higher by 50° to 60° C. than that of the aluminum-killed steel mask, thereby giving rise to a cause of a larger thermal deformation of the Invar mask. In order to prevent such a temperature rise, the same darkened oxide layer as in the aluminum-killed steel mask can be formed on the Invar mask to increase heat radiation. However, when the mask surface of the Invar mask after annealing was precisely examined by an ion microanalyzer (IMA), the presence of chromium was detected. It was found that the concentrated chromium was oxidized to form an inactive film having good anticorrosion properties, i.e., the surface was converted to stainless steel, and unlike Fe—Ni, growth of the oxide film on the surface was largely prevented. The present inventors then assumed that the chromium oxide formed on the surface of the mask after annealing in a vacuum could be reduced and cooling could be performed in a reducing atmosphere to inhibit oxidation of the mask surface. After the mask was annealed at a temperature of 1,100° C. and a vacuum pressure of $10^{-2}$ torr for 10 minutes, the mask was cooled in the furnace while hydrogen was supplied thereto. When the mask was removed from the furnace upon cooling, it was covered with non-corrosion paper and was held in a case with a deoxidizer.

After pressing, press oil was removed from the mask by Trichrene steam cleaning, and a darkened film was formed under the same conditions as described above. The same darkened film as in the aluminum killed steel mask was obtained. Furthermore, the film obtained by steam darkening had excellent density and adhesion properties and degree of darkness. During steam darkening, when the layer is formed in a strong oxidizing atmosphere with a small amount of steam, rust dots are formed on the darkened layer which has poor adhesion properties. However, when the amount of steam is increased to obtain a weak oxidizing atmosphere, a dense layer with good adhesion strength can be obtained, but a long period of time is required to obtain a sufficient degree of darkness. Such a condition is not suitable for mass production. In order to resolve the problem, the present inventors assumed that a thin darkened layer having good adhesion properties could be formed in the weak oxidizing atmosphere during the first half period and then in the strong oxidizing atmosphere during the second half period. Based upon this assumption, the present inventors made various tests. According to the present inventors, darkening was performed at a temperature of 500° to 700° C. for 10 minutes or more while steam was supplied at a rate of 20 to 50 $m^3$/hr per unit cubic meter of the reaction chamber during the first half period. Darkening was then continued at a temperature of 550° to 750° C. for 10 minutes or more while steam was supplied at a rate of 0 to 20 $m^3$/hr per unit cubic meter of the chamber. As a result, the darkened layer had sufficient darkness and good adhesion properties. The adhesion properties of the darkened layer were evaluated such that a 90° bending test followed by a peeling test of the darkened layer by adhesion of cellophane tape to the bent portion was made. In addition, the darkened layer state was observed through a scanning electron microscope. The resultant layer was a dense film without cracks and pinholes. In forming the darkened layer, layer quality varies due to different structures of darkening furnaces even if identical conditions are established. Therefore, proper conditions must be selected for a specific darkening furnace so as to fall within the above-mentioned ranges. In addition, darkening need not be performed under different conditions during the first and second half periods. The oxidation effect can be changed in steps from a weak to a strong effect by changing the amount of steam and temperature.

In the above embodiment, the 36 Ni Invar alloy is used as the shadow mask material. However, the present invention is not limited to this material. For example, any Fe—Ni alloy containing super Invar, such as 42 Ni alloy and 32 Ni—5Co can be used. Furthermore, the darkening method of the present invention can also be used for an Fe—Ni alloy such as a mask frame and an inner shield which are incorporated in a color picture tube, in addition to a shadow mask.

The annealing process in the present invention may be carried out in an ordinary hydrogen atmosphere as disclosed in Japanese Patent Disclosure No. 59-200721 by adopting molding strain-diminishing measures such as a hot-pressing or by making smooth the boundary portion between the central curved portion and outer fringe portion of the shadow mask, in which a molding strain is likely to be concentrated at the time of a press molding.

According to the present invention, the darkened oxide film has good pressing, anticorrosion and heat radiation properties. As a result, a shadow mask of an Fe—Ni alloy having good white uniformity quality and free from purity drift can be obtained.

What is claimed is:

1. A method of manufacturing a picture tube shadow mask, comprising the steps of forming a plurality of mask apertures in a thin metal plate having iron and nickel as major constituents, annealing the metal plate with the plurality of mask apertures, the annealing being performed at a temperature of not lower than 1,000° C. at a vacuum pressure of not higher than $10^{-1}$ torr, hydrogen gas being continuously supplied to provide a reducing atmosphere, and forming a darkened oxide layer on the annealed metal plate, wherein cooling after annealing is performed in a reducing atmosphere, and the darkened oxide layer is formed at first in a weak oxidizing steam atmosphere and then in a strong oxidizing steam atmosphere.

2. A method according to claim 1, wherein the hydrogen gas is continuously supplied to provide a reducing atmosphere until an atomosphere temperature becomes 500° C.

3. A method according to claim 1, wherein the darkened oxide layer is formed by supplying at first the steam at a rate of 20 to 50 $m^3$/hr per unit volume of a treatment furnace at a temperature of 500° to 700° C. for not less than 10 minutes and then at a rate not more than 20 $m^3$/hr per unit volume of the treatment furnace at a temperature of 550° to 750° C. for not less than 10 minutes.

4. A method according to claim 2, wherein the shadow mask is held in a deoxidizing atmosphere between said annealing step and said forming step.

5. A method according to claim 1 wherein the darkened oxide layer is formed by first supplying the steam at a rate of 20 to 50 $m^3$/hr. per unit volume of treatment furnace at a temperature of 500° to 700° C., and then gradually decreasing the steam supply rate to not more than 20 $m^3$/hr. per unit volume of the treatment furnace and increasing the temperature to 550° to 750° C.

* * * * *